US010663897B2

(12) United States Patent
Hoshio et al.

(10) Patent No.: US 10,663,897 B2
(45) Date of Patent: May 26, 2020

(54) FIXING MEMBER, METHOD FOR PRODUCING FIXING MEMBER, FIXING DEVICE, AND IMAGE FORMING APPARATUS

(71) Applicant: FUJI XEROX CO.,LTD., Tokyo (JP)

(72) Inventors: Takuro Hoshio, Kanagawa (JP); Ryosuke Fujii, Kanagawa (JP); Kenji Omori, Kanagawa (JP); Jun Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/262,958

(22) Filed: Jan. 31, 2019

(65) Prior Publication Data

US 2020/0026229 A1 Jan. 23, 2020

(30) Foreign Application Priority Data

Jul. 17, 2018 (JP) ..... 2018-134299

(51) Int. Cl.
*G03G 15/20* (2006.01)
*G03G 15/02* (2006.01)

(52) U.S. Cl.
CPC ..... *G03G 15/2053* (2013.01); *G03G 15/0225* (2013.01); *G03G 15/0233* (2013.01); *G03G 2215/2048* (2013.01); *G03G 2215/2096* (2013.01)

(58) Field of Classification Search
CPC ..... G03G 15/0233; G03G 15/0225; G03G 15/2053; G03G 2215/2048; G03G 2215/2096
See application file for complete search history.

(56) References Cited

U.S. PATENT DOCUMENTS

2007/0065192 A1* 3/2007 Daishi ..... G03G 15/2057 399/329
2007/0280755 A1* 12/2007 Matsumoto ..... G03G 15/206 399/329
2017/0308011 A1* 10/2017 Koga ..... G03G 15/2057

FOREIGN PATENT DOCUMENTS

JP 4790002 10/2011

* cited by examiner

*Primary Examiner* — Gregory H Curran
(74) *Attorney, Agent, or Firm* — JCIPRNET

(57) ABSTRACT

A fixing member includes a substrate, an elastic layer on the substrate, and a surface layer on the elastic layer. The surface layer has transverse microhardness values within the range of 85 to 89, inclusive, and a transverse filtered maximum waviness (Wcm) of 0.1 μm or more and 4 μm or less.

14 Claims, 4 Drawing Sheets

FIXING MEMBER, METHOD FOR PRODUCING FIXING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2018-134299 filed Jul. 17, 2018.

BACKGROUND

(i) Technical Field

The present disclosure relates to a fixing member, a method for producing a fixing member, a fixing device, and an image forming apparatus.

(ii) Related Art

Electrophotographic image forming apparatuses (photocopiers, facsimiles, printers, etc.) form images by creating an unfixed toner image on a recording medium and fixing the toner image with a fixing device.

For example, Japanese Patent No. 4790002 discloses a method for producing a fixing member having a cylindrical elastic layer and a fluoropolymer tube covering the circumferential surface of the cylindrical elastic layer. This method includes (1) forming, by extrusion, a fluoropolymer tube having an inner diameter smaller than the outer diameter of the cylindrical elastic layer, (2) dilating the fluoropolymer tube and putting it over the cylindrical elastic layer, and (3) longitudinally stretching the fluoropolymer tube over the cylindrical elastic layer and heating the fluoropolymer tube in this state.

A fixing member has, for example, a substrate, an elastic layer on the substrate, and a surface layer on the elastic layer. In the related art, the surface layer can be nonuniform in hardness in the direction along the axis of the fixing member and have only a small waviness, depending on the method used to form it. Repeated formation of images using a fixing member having a surface layer nonuniform in hardness in the direction along the axis of the fixing device and small in waviness can cause the surface layer of the fixing member to crease, crack, or experience other defects. Further repeating image formation in this state often produces density unevenness in the resulting images.

SUMMARY

Aspects of non-limiting embodiments of the present disclosure relate to a fixing member having a substrate, an elastic layer, and a surface layer. With this fixing member, images can be repeatedly formed with reduced density unevenness compared with if the surface layer had a microhardness less than 85 or exceeding 89 or a filtered maximum waviness (Wcm) of less than 0.1 μm or exceeding 4 μm in the transverse direction, or in the direction along the axis of the fixing member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing member including a substrate, an elastic layer on the substrate, and a surface layer on the elastic layer. The surface layer has transverse microhardness values within the range of 85 to 89, inclusive, and a transverse filtered maximum waviness (Wcm) of 0.1 μm or more and 4 μm or less.

BRIEF DESCRIPTION OF THE DRAWINGS

Exemplary embodiments of the present disclosure will be described in detail based on the following figures, wherein.

DETAILED DESCRIPTION

The following describes exemplary embodiments as examples of the present disclosure.

Functionally equivalent elements are indicated by like designators throughout the drawings. Redundant description of such elements may be omitted as appropriate.

Fixing Member

The following describes a fixing member according to an exemplary embodiment.

Figure 1:
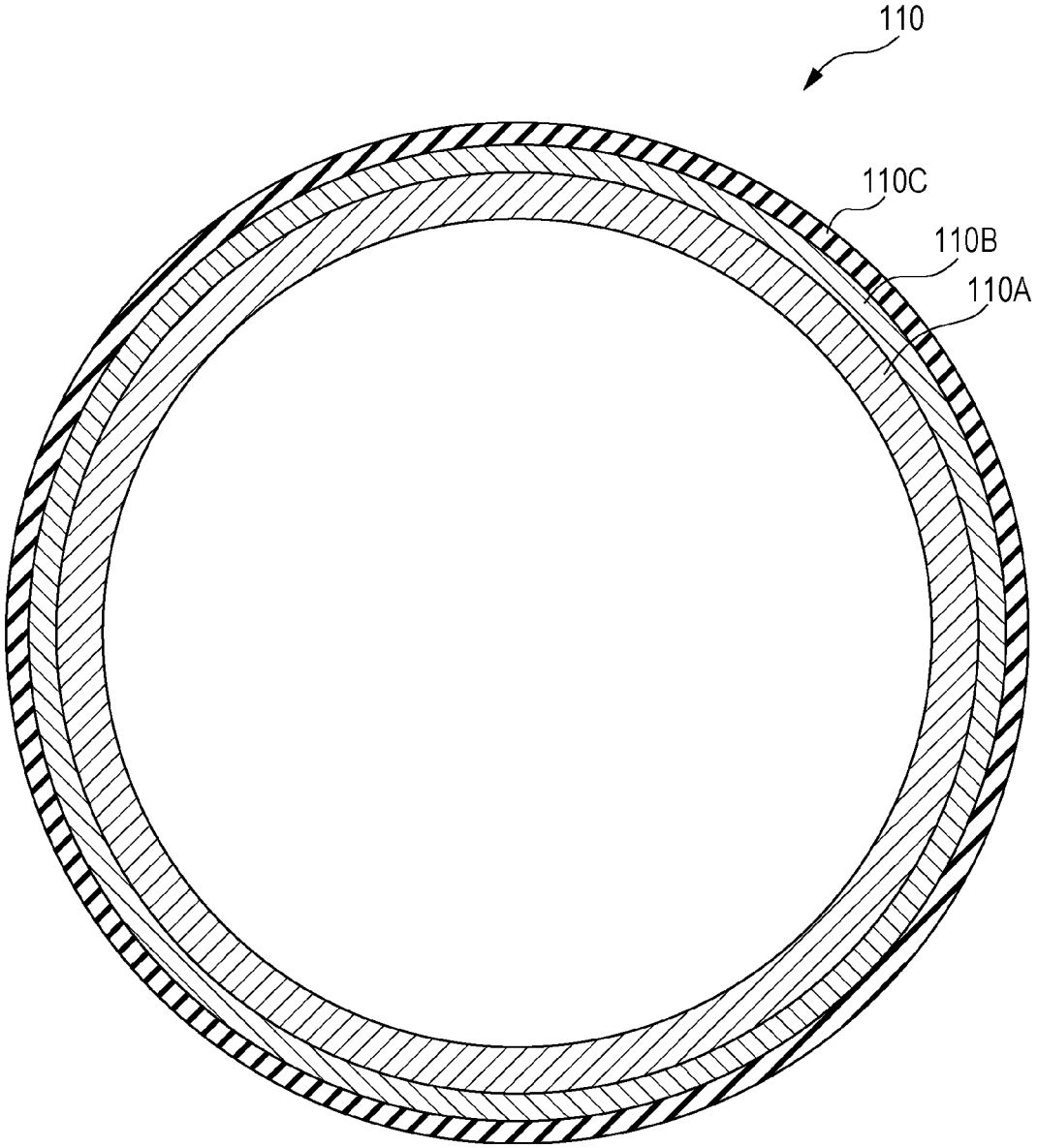
FIG. 1 is a schematic cross-section illustrating an example of a fixing member according to an exemplary embodiment.

FIG. 1 is a schematic cross-section illustrating an example of a fixing member according to this exemplary embodiment.

As illustrated in FIG. 1, a fixing member 110 according to this exemplary embodiment has, for example, a substrate 110A, an elastic layer 110B on the substrate 110A, and a surface layer 110C on the elastic layer 110B.

The surface layer 110C has microhardness values within the range of 85 to 89, inclusive, and a filtered maximum waviness (Wcm) of 0.1 μm or more and 4 μm or less both in the transverse direction, or in the direction along the axis of the fixing member 110.

It should be understood that this is not the only possible layer structure of the fixing member 110 according to this exemplary embodiment. Other layer structures may also be used; for example, there may be a metal layer and a protective layer for it between the substrate 110A and elastic layer 110B if necessary. In the following, designators are omitted.

In the related art, the surface layer of a fixing member can be nonuniform in hardness and have only a small waviness, depending on the method used to form it. Repeated production of images using a fixing member having a surface layer nonuniform in hardness causes the surface layer of the fixing member to crease, crack, or experience other defects, and the images produced are likely to be uneven in density.

For example, Japanese Patent No. 4790002 discloses forming a fluoropolymer surface layer on an elastic layer by covering the elastic layer with a fluoropolymer tube and then heating the tube while stretching and holding it at a percentage elongation of 6% or more and 8% or less, arguing that a fluoropolymer surface layer formed in this way has a reduced degree of orientation without loss of crystallinity.

As a result, the surface layer does not easily crease or crack in the transverse (longitudinal) direction, or in the direction along the axis of the fixing member, even if the fixing member is used repeatedly.

The surface layer obtained by this method, however, is nonuniform in microhardness because of plastic deformation of the stretched fluoropolymer tube, and also has only a small waviness as a result of the stretching causing the plastic deformation. Indeed, repeated use of a fixing member having such a surface layer is more likely to result in defects, such as creases, in the surface layer and is a cause of density unevenness in the resulting images. This, the inventors believe, is due to nonuniformity in the microhardness of the surface layer. During repeated formation of images, the fixing member comes into contact with the recording medium, such as paper. Exposed to the contact pressure repeatedly, the fixing member deforms, often to different extents from point to point because of its nonuniform microhardness. Moreover, the small waviness of the surface layer means that little of the pressure repeatedly applied to the fixing member during repeated formation of images is absorbed by the surface layer.

By contrast, the surface layer of a fixing member according to this exemplary embodiment has less varying microhardness in the transverse direction, or in the direction along the axis of the fixing member, than in the related art as described above. The range of filtered maximum waviness (Wcm) allowed is also broader than in the related art, although too large a Wcm can also be a cause of density unevenness in the resulting images.

According to this exemplary embodiment, a method for producing a fixing member includes forming an elastic layer on a substrate and forming a surface layer on the elastic layer. The surface layer is formed by dilating a material for forming the surface layer, covering the elastic layer with the material for forming the surface layer while transversely stretching the material within its elastic deformation range, and narrowing the material for forming the surface layer.

In this exemplary embodiment, the material for forming the surface layer (e.g., a fluoropolymer) is stretched within its elastic deformation range when the elastic layer is covered with the material. It is to be noted that the term transversely as used with the surface layer means longitudinally, or in the direction along the axis of the fixing member.

The following describes the components of a fixing member according to an exemplary embodiment in detail.

Shape of the Fixing Member

A fixing member according to this exemplary embodiment may be roller-shaped or belt-shaped.

Substrate

For a roller-shaped fixing member, the substrate can be, for example, a cylinder of metal (e.g., aluminum, stainless steel, iron, or copper), alloy, ceramic material, fiber-reinforced metal (FRM), or any similar material.

The outer diameter of the substrate for a roller-shaped fixing member can be, for example, 10 mm or more and 50 mm or less. As for thickness, an aluminum substrate, for example, can have a thickness of 0.5 mm or more and 4 mm or less, and a stainless steel or iron substrate can have a thickness of 0.1 mm or more and 2 mm or less.

For a belt-shaped fixing member, the substrate can be, for example, a metal belt (e.g., a belt of nickel, aluminum, or stainless steel) or a resin belt (e.g., a belt of polyimide, polyamide-imide, polyphenylene sulfide, polyether ether ketone, or polybenzimidazole).

The resin belt may contain, for example, an electrically conductive powder dispersed therein to control its volume resistivity. A specific example of such a resin belt is a polyimide belt containing carbon black dispersed therein to control its volume resistivity. Another exemplary resin belt is one prepared by joining interlocking ends of a long polyimide sheet together and heat-bonding these ends using a heat-bonding member to form a belt.

The thickness of the substrate for a belt-shaped fixing member can be, for example, 20 μm or more and 200 μm or less, desirably 30 μm or more and 150 μm or less, more desirably 40 μm or more and 130 μm or less.

Elastic Layer

The elastic layer can be, for example, one that contains silicone rubber.

The silicone rubber can be, for example, room-temperature vulcanizing (RTV), high-temperature vulcanizing (HTV), or liquid silicone rubber. Specific examples include polydimethyl silicone (MQ), methyl vinyl silicone (VMQ), methyl phenyl silicone (PMQ), and fluorosilicone (FVMQ) rubber.

The elastic layer may be formed of, for example, a silicone rubber composition that contains an organopolysiloxane having two or more alkenyl groups per molecule, an organohydrogenpolysiloxane having two or more SiH groups per molecule, and a thermally activated catalyst.

The organopolysiloxane having two or more alkenyl groups per molecule can be of any kind. Known materials can be used.

Specific examples of organopolysiloxanes include organopolysiloxanes such as a dimethylsiloxane/methylvinylsiloxane copolymer trimethylsiloxy-terminated at both ends, a methylvinylpolysiloxane trimethylsiloxy-terminated at both ends, a dimethylsiloxane/methylvinylsiloxane/methylphenylsiloxane copolymer trimethylsiloxy-terminated at both ends, a dimethylpolysiloxane dimethylvinylsiloxy-terminated at both ends, a methylvinylpolysiloxane dimethylvinylsiloxy-terminated at both ends, a dimethylsiloxane/methylvinylsiloxane copolymer dimethylvinylsiloxy-terminated at both ends, a dimethylsiloxane/methylvinylsiloxane/methylphenylsiloxane copolymer dimethylvinylsiloxy-terminated at both ends, a dimethylpolysiloxane divinylmethylsiloxy-terminated at both ends, a dimethylsiloxane/methylvinylsiloxane copolymer divinylmethylsiloxy-terminated at both ends, a dimethylpolysiloxane trivinylsiloxy-terminated at both ends, and a dimethylsiloxane/methylvinylsiloxane copolymer trivinylsiloxy-terminated at both ends.

One of these organopolysiloxanes may be used alone, or two or more may be used in combination.

The organohydrogenpolysiloxane having two or more SiH groups per molecule can be of any kind. Known materials can be used.

Specific examples include organohydrogenpolysiloxanes such as 1,1,3,3-tetramethyldisiloxane, 1,3,5,7-tetramethylcyclotetrasiloxane, methylhydrogencyclopolysiloxane, a methylhydrogensiloxane/dimethylsiloxane cyclic copolymer, tris(dimethylhydrogensiloxy)methylsilane, tris(dimethylhydrogensiloxy)phenylsilane, a methylhydrogenpolysiloxane trimethylsiloxy-terminated at both ends, a dimethylsiloxane/methylhydrogensiloxane copolymer trimethylsiloxy-terminated at both ends, a dimethylpolysiloxane dimethylhydrogensiloxy-terminated at both ends, a dimethylsiloxane/methylhydrogensiloxane copolymer dimethyhydrogensiloxy-terminated at both ends, a methylhydrogensiloxane/diphenylsiloxane copolymer trimethylsiloxy-terminated at both ends, a methylhydrogensiloxane/ diphenylsiloxane/dimethylsiloxane copolymer trimethylsiloxy-terminated at both ends, a cyclic methylhydrogenpolysiloxane, a cyclic methylhydrogensiloxane/dimethylsiloxane copolymer, and a cyclic methylhydrogensiloxane/diphenylsiloxane/dimethylsiloxnae copolymer.

One of these organohydrogenpolysiloxanes may be used alone, or two or more may be used in combination.

Thermally activated catalysts are catalysts that are activated by heating and not by ultraviolet irradiation. The thermally activated catalyst can be of any kind as long as it is activated by heating. For example, the thermally activated catalyst can be a platinum-group metal or a compound of a platinum-group metal. Specific examples of the thermally activated catalysts include platinum-group metals, such as platinum, palladium, and rhodium; chloroplatinic acid; alcohol-denatured chloroplatinic acid; coordination compounds of chloroplatinic acid and an olefin, vinylsiloxane, or acetylene compound; tetrakis(triphenylphosphine)palladium; and chlorotris(triphenylphosphine)rhodium. One of these thermally activated catalysts may be used alone, or two or more may be used in combination.

The silicone rubber composition for forming the elastic layer may contain an adhesive component, which herein refers to a component that provides adhesiveness. In other words, the silicone rubber composition may contain an adhesive component. The adhesive component can be, for example, an alkoxysilane compound. Examples of the alkoxysilane compound include functional alkoxysilane compounds, for example having a vinyl, epoxy, or (meth) acryloxy (encompassing acryloxy and methacryloxy) group. Specific examples of adhesive components include glycidoxypropyltriethoxysilane, vinyltrimethoxysilane, vinyltriethoxysilane, glycidoxypropyltrimethoxysilane, glycidoxypropylmethyldiethoxysilane, methacryloxypropylmethyldiethoxysilane, methacryloxypropyltriethoxysilane, and allyltriethoxysilane.

The adhesive component can be in any quantity. For example, the amount of adhesive component can be 0.5% by mass or more and 20% by mass or less of the total solid mass of the elastic layer.

The elastic layer may contain additives. Examples of additives that can be used include softening agents (e.g., paraffins), processing aids (e.g., stearic acid), antioxidants (e.g., amines), vulcanizing agents (e.g., sulfur, metal oxides, and peroxides), and functional fillers (e.g., alumina).

The thickness of the elastic layer can be, for example, 20 μm or more and 1000 μm or less, preferably 30 μm or more and 800 μm or less, more preferably 100 μm or more and 500 μm or less.

Surface Layer

The surface layer contains, for example, a heat-resistant mold lubricant.

Examples of heat-resistant mold lubricants that can be used include fluororubbers, fluoropolymers, silicone resins, and polyimide resins.

In particular, fluoropolymers are preferred as the heat-resistant mold lubricant. A surface layer containing a fluoropolymer is usually prone to creasing if formed thin, but in this exemplary embodiment, the surface layer is less likely to experience creases and other defects.

Specific examples of such fluoropolymers include tetrafluoroethylene/perfluoroalkyl vinyl ether copolymers (PFA), polytetrafluoroethylene (PTFE), tetrafluoroethylene/hexafluoropropylene copolymers (FEP), polyethylene/tetrafluoroethylene copolymers (ETFE), polyvinylidene fluoride (PVDF), polychlorotrifluoroethylene (PCTFE), and polyvinyl fluoride (PVF).

The thickness of the surface layer can be 5 μm or more and 100 μm or less for reduced density unevenness in the resulting images. For example, it is preferred that the thickness of the surface layer be 5 μm or more and 50 μm or less, more preferably 10 μm or more and 40 μm or less.

The tube for forming the surface layer may have its inner surface treated beforehand for improved adhesiveness to the elastic layer. Examples of such treatments include exposure to liquid ammonia, exposure to naphthalene sodium, excimer laser irradiation, and plasma treatment.

The following describes a method according to an exemplary embodiment for producing a fixing member.

A method according to this exemplary embodiment for producing a fixing member includes forming an elastic layer on a substrate and forming a surface layer on the elastic layer. The surface layer is formed by dilating a material for forming the surface layer, covering the elastic layer with the material for forming the surface layer while transversely stretching the material within its elastic deformation range, and narrowing the material for forming the surface layer.

The following is a specific description of a method for forming a fixing member, although other methods may also work.

First, the formation of an elastic layer is described.

A substrate, for example belt-shaped, is prepared.

Then the prepared substrate is coated with a solution for forming the elastic layer, for example a solution of a silicone rubber composition, by a known process to form an elastic layer. The elastic layer is then covered with the material for forming the surface layer to form a surface layer.

The elastic layer may be formed together with the surface layer as follows. For example, the substrate is coated with a solution of a silicone rubber composition for forming the elastic layer by a known process, such as blade coating, to form a coating for forming the elastic layer. The solution for forming the elastic layer contains a thermally activated catalyst. Then with the coating for forming the elastic layer half-cured, a tube of heat-resistant mold lubricant (e.g., fluoropolymer), which will later become the surface layer, is dilated and put over the coating. During this, the tube is transversely stretched within its elastic deformation range. Then the tube is narrowed. The tube-covered coating for forming the elastic layer, still half-cured at this stage, is then fired to cure. This gives an elastic layer made of cured silicone rubber composition. Any firing conditions can be used as long as the half-cured coating for forming an elastic layer cures. An example is a temperature of 100° C. or more and 230° C. or less.

Next, the formation of a surface layer is described. In the following description, the material for forming the surface layer is a fluoropolymer.

First, a tube of fluoropolymer is prepared as the material for forming the surface layer. The fluoropolymer tube can be, for example, a product of extrusion obtained by feeding a fluoropolymer to an extruder, melting the fluoropolymer there, extruding the melt through a die of a predetermined size, and cooling the extruded melt.

The extrusion for forming the fluoropolymer tube begins with feeding fluoropolymer pellets to the cylinder section (extruding screw section) of the extruder. The pellets are then kneaded and extruded at a predetermined extrusion rate under heat. The melted fluoropolymer is extruded and shaped into a tube through a ring-shaped nozzle, and the tube is cooled while being drawn through a sizing die. During the cooling, the inner diameter of the tube is adjusted.

The film thickness of the fluoropolymer tube (thickness of the film forming the tube) is determined by the rate of extrusion and the rate of drawing. For example, a fluoropolymer tube with a film thickness of 5 μm or more and 100 μm or less is obtained.

The inner diameter of the fluoropolymer tube can be smaller than the outer diameter of the elastic layer. For example, the fluoropolymer tube can be shaped so that the difference between the inner diameters of the fluoropolymer tube before and after covering the elastic layer will be 4% or more and 7% or less of the inner diameter before covering. Giving the fluoropolymer tube an inner diameter smaller than the outer diameter of the elastic layer means that the tube is dilated while being put over the elastic layer.

The thus-obtained fluoropolymer tube is dilated and put over the elastic layer. During this, the fluoropolymer tube is transversely stretched within its elastic deformation range. Then the tube is narrowed.

The covering of the elastic layer with the fluoropolymer tube can be done by any method. For example, the fluoropolymer tube may be dilated from inside or from outside while being put over the elastic layer. An adhesive agent, for example an addition-curing silicone rubber, may optionally be used between the elastic layer and the fluoropolymer tube.

If the fluoropolymer tube is put over the elastic layer with dilatation from inside, a possible method can be as follows. That is, a substrate with the elastic layer thereon is prepared, and an inner mold is inserted to the inside, or into the space surrounded by the inner circumferential surface, of the substrate. The substrate with the inner mold therein is then inserted into the inside of the fluoropolymer tube, dilating the tube. After the insertion of the substrate, one end of the fluoropolymer tube is fastened at multiple circumferential points. Then the other end of the fluoropolymer tube is stretched to a predetermined percentage elongation, based on the length of the tube upon covering, within its elastic deformation range and fastened at multiple circumferential points. The points where the ends of the tube are fastened can be selected from, for example, where the images will not come when the fixing member is used as a belt-shaped fixing member. Then the dilation is ended, and this makes the elastic layer covered with the fluoropolymer tube and the tube narrow. On the elastic layer, there may be an adhesive agent, for example an addition-curing silicone rubber, applied thereto.

It is to be noted that this is not the only possible method for putting the fluoropolymer tube over the elastic layer with dilatation from inside. For example, the fluoropolymer tube may be attached to a container. Air is removed from the container, and a substrate with the elastic layer thereon and an inner mold therein is inserted into the fluoropolymer tube. The fluoropolymer tube is stretched to a predetermined percentage elongation within its elastic deformation range. Then the suction is ended, and this makes the elastic layer covered with the fluoropolymer tube and the tube narrow. The inner mold may have a dilator at its end, preferably the end from which the inner mold is inserted into the fluoropolymer tube, to help the tube dilate and cover the elastic layer. On the elastic layer, there may be an adhesive agent, for example an addition-curing silicone rubber, applied thereto.

If the fluoropolymer tube is put over the elastic layer with dilatation from outside, a possible method can be as follows. First, a substrate with the elastic layer thereon is prepared, and the fluoropolymer tube is stretched to a predetermined percentage elongation within its elastic deformation range using an outer mold whose inner diameter is larger than the outer diameter of the substrate including the elastic layer. With the fluoropolymer tube held stretched, the ends of the tube are fastened, for example by folding back the ends onto the outer surface of the outer mold. Then the space between the outer circumferential surface of the fluoropolymer tube and the inner surface of the dilator is evacuated to dilate the tube and make the outer circumferential surface of the tube fit the inner surface of the dilator tightly. The substrate, with the elastic layer thereon, is then inserted to the inside, or into the space surrounded by the inner circumferential surface, of the fluoropolymer tube. Then the vacuum between the outer surface of the fluoropolymer tube and the inner surface of the dilator is released, and this makes the surface of the elastic layer tightly covered and the fluoropolymer tube narrow. On the elastic layer, there may be an adhesive agent, for example an addition-curing silicone rubber, applied thereto.

The percentage dilatation of the fluoropolymer tube (percentage of the inner diameter after dilatation to that before dilatation) can be 4% or more and 7% or less for reduced risk of, for example, the fluoropolymer tube breaking while being put over the elastic layer. The percentage dilatation is determined by conditions such as the size of the ring-shaped die and the draw-down ratio used for the extrusion of the fluoropolymer tube.

Incidentally, temporarily fastening the ends of the fluoropolymer tube before heating (described hereinafter) will help hold the tube dilated circumferentially and stretched transversely (longitudinally) during the heating. The temporary fastening of the ends can be done by any method. An example is to cure at least part of the ends of the fluoropolymer tube covering the elastic layer.

The percentage elongation refers to the percentage of the increase in the transverse (longitudinal) length of the surface layer (fluoropolymer tube in the above example) covering the elastic layer, or the length in the direction along the axis of the fixing member, to the total transverse length of the surface layer upon covering. The percentage elongation is selected within the elastic deformation range as determined from measured tensile properties of the surface layer. Specifically, the percentage elongation can be 0% or more and 5% or less (preferably, 1% or more and 4% or less).

Selecting a percentage elongation within the elastic deformation range (in particular, a percentage elongation of 0% or more and 5% or less (preferably, 1% or more and 4% or less)) will ensure that the microhardness values of the surface layer after covering the elastic layer fall within the range of 85 to 89, inclusive, in the transverse direction (longitudinal direction), or the direction along the axis of the fixing member. The circumferential microhardness values also fall within the range of 85 to 89, inclusive. The variations in microhardness, moreover, are smaller than they would otherwise be, so the difference between the maximum and minimum transverse microhardness values (maximum-minimum) and that between the maximum and minimum circumferential microhardness values (maximum-minimum) are 2 or less. Furthermore, the average transverse microhardness is 86 or more and 88 or less, and the average circumferential microhardness is also 86 or more and 88 or less.

The transverse (longitudinal) microhardness values of the surface layer, or the microhardness values in the direction along the axis of the fixing member, are measurements taken by dividing the surface layer of the fixing member of interest into five equally sized segments along the transverse direction and measuring the microhardness of the middle of each segment. Likewise, the circumferential microhardness values of the surface layer are measurements taken by dividing the middle of the surface layer in the transverse direction into five equally sized segments along the circumferential direction and measuring the microhardness of the middle of each segment. Whether transverse or circumferential, all five measured microhardness values fall within the range of 85 to 89, inclusive. The difference between the maximum and minimum transverse or circumferential microhardness values refers to the smallest of the five measurements subtracted from the largest. The average transverse microhardness is the average of the five measured microhardness values, and the average circumferential microhardness is the average of the five measured microhardness values. The microhardness values are measured using MD-1 microdurometer (polymer A-type (Kobunshi Keiki)).

In a method according to this exemplary embodiment for producing a fixing member, transversely stretching the surface layer within its elastic deformation range means that the percentage of the increase in the transverse (longitudinal) length of the surface layer covering the elastic layer, or the length in the direction along the axis of the fixing member, to the total transverse length of the surface layer upon covering (percentage elongation) is 0% or more and is less than the plastic deformation range of the material forming the surface layer (e.g., a fluoropolymer). A percentage elongation of less than 0% (negative percentage elongation) means that the surface layer has transversely contracted from the total length of the surface layer upon the covering of the elastic layer.

Selecting a percentage elongation within the elastic deformation range (in particular, a percentage elongation of 0% or more and 5% or less (preferably, 1% or more and 4% or less)) will also ensure that the filtered maximum waviness (Wcm) in the transverse direction, or in the direction along the axis of the fixing member, is 0.1 μm or more and 4.0 μm or less. The transverse Wcm can be 0.1 μm or more and 1.0 μm or less for reduced density unevenness in the resulting images, preferably 0.5 μm or more and 1.0 μm or less.

The filtered maximum waviness (Wcm) is measured along the axis of the fixing member, for example using a surface roughness measuring instrument (SURFCOM 2000, Tokyo Seimitsu Co., Ltd.) and as per JIS B 0601.

The heating can alternatively be, for example, performed simultaneously with the curing of the elastic layer. If an adhesive layer is formed on the elastic layer, the heating can be performed simultaneously with the curing of the adhesive layer. Exemplary heating conditions are a heating temperature of 200° C. or more and 250° C. or less and a heating duration of 10 minutes or more and 60 minutes or less. Any heater can be used, and an example is an electric furnace. After the heating, the ends of the fluoropolymer tube are cut to the desired length. In this way, a fixing member is obtained.

Applications of the Fixing Member

A heating roller, a pressure roller, a heating belt, and a pressure belt, for example, are all possible applications of a fixing member according to an exemplary embodiment. The heat source for a heating roller or heating belt can be, for example, an external heat source or an electromagnetic induction heater.

Fixing Device

Fixing devices according to an exemplary embodiment vary in construction. A possible construction includes a first rotor and a second rotor in contact with the outer surface of the first rotor. At least one of the first and second rotors is a fixing member according to an exemplary embodiment.

The following describes fixing devices having a heating belt and a pressure roller as Embodiments 1 and 2. In Embodiments 1 and 2, any of the heating belt and pressure roller can be a fixing member according to an exemplary embodiment.

It should be noted that fixing devices according to exemplary embodiments are not limited to Embodiments 1 and 2 but encompass fixing devices having a heating roller or heating belt and a pressure belt. Any of the heating roller, heating belt, and pressure belt can be a fixing member according to an exemplary embodiment.

Fixing devices according to exemplary embodiments, moreover, are not limited to Embodiments 1 and 2 but encompass fixing devices using electromagnetic induction heating.

Fixing Device of Embodiment 1

Figure 2:
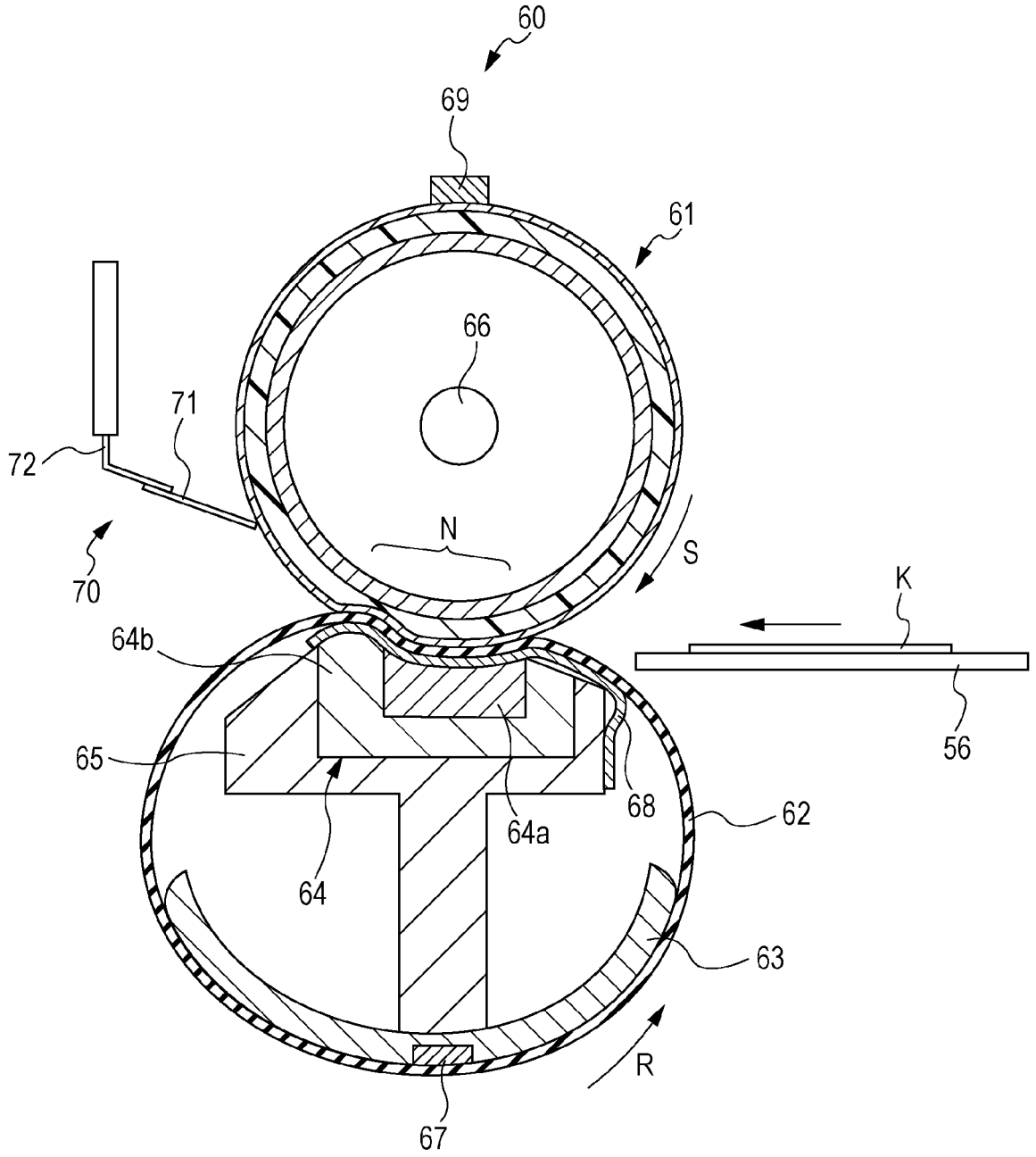
FIG. 2 schematically illustrates an example of a fixing device according to Embodiment 1.

The following describes a fixing device according to Embodiment 1. FIG. 2 schematically illustrates an example of a fixing device according to Embodiment 1.

As illustrated in FIG. 2, a fixing device 60 according to Embodiment 1 includes, for example, a heating roller 61 (example of the first rotor) that rotates, a pressure belt 62 (example of the second rotor), and a pressing pad 64 (example of a pressing member) that presses the heating roller 61 with the pressure belt 62 therebetween.

The pressing pad 64 only needs to provide, for example, relative pressing between the pressure belt 62 and heating roller 61. That is, the pressure belt 62 may be pressed against the heating roller 61, or the heating roller 61 may be pressed against the pressure belt 62.

Inside the heating roller 61 is a halogen lamp 66 (example of a heater). The heater does not need to be a halogen lamp and may be another structural member that generates heat.

On the surface of the heating roller 61, there is a temperature sensor 69, for example, in contact with the surface. The operation of the halogen lamp 66 is controlled on the basis of measured temperatures from this temperature sensor 69 so that the surface of the heating roller 61 will stay at a preset temperature (e.g., 150° C.).

The pressure belt 62 is rotatably supported, for example by the pressing pad 64 and a guide 63 for belt running both placed inside the pressure belt 62. The pressure belt 62 is pressed against the heating roller 61 by the pressing pad 64 in a nip region N.

The pressing pad 64 is, for example, inside the pressure belt 62 in such a manner that it can press the heating roller 61 with the pressure belt 62 interposed therebetween. The pressing pad 64 and the heating roller 61 form the nip region N therebetween.

The pressing pad 64 has, for example, a pre-nip member 64*a* for ensuring that the nip region N is broad in width, and a peel-nip member 64*b* for deforming the heating roller 61. The pre-nip member 64*a* is closer to the entry to the nip region N, and the peel-nip member 64*b* is closer to the exit from the nip region N.

To reduce the sliding friction between the inner circumferential surface of the pressure belt 62 and the pressing pad 64, for example, a sheet-shaped slider 68 extends on the surface of the pre-nip member 64*a* and peel-nip member 64*b* touching the pressure belt 62. The pressing pad 64 and the slider 68 are held by a metal holder 65.

The slider 68 is set in such a manner that, for example, its surface for sliding will touch the inner circumferential surface of the pressure belt 62. There is oil between the pressure belt 62 and the slider 68, and the design of the surface for sliding is relevant to the retention and supply of this oil.

The holder 65 is fitted with, for example, a guide 63 for belt running along which the pressure belt 62 moves around.

The heating roller 61 is rotated in the direction of arrow S, for example by a motor not illustrated. Driven by this rotation, the pressure belt 62 rotates in the direction of arrow R, opposite the direction of rotation of the heating roller 61. For example, the heating roller 61 rotates clockwise in FIG. 2, whereas the pressure belt 62 rotates counterclockwise.

The paper K (example of a recording medium), with an unfixed toner image thereon, is transported to the nip region N, for example guided by a guide 56 for the entry to fixation. While the paper K passes through the nip region N, the toner image on the paper K is fixed by the pressure and heat acting on the nip region N.

The fixing device 60 according to Embodiment 1 is configured with, for example, the pre-nip member 64*a* concave to fit the outer circumferential surface of the heating roller 61. This ensures that the nip region N is broader in width than it would be without the pre-nip member 64*a*.

Moreover, the fixing device 60 according to Embodiment 1 is configured with, for example, the peel-nip member 64*b* sticking out to push the outer circumferential surface of the heating roller 61. This ensures that the heating roller 61 is greatly deformed locally at the exit from the nip region N.

Such a placement of the peel-nip member 64*b* means, for example, the paper K after fixation moves along the greatly deformed portion of the heating roller 61 while passing through the peel-nip region, helping the paper K peel off the heating roller 61.

To further assist the peeling off of the paper K, there is a scraper 70, for example, downstream of the nip region N of the heating roller 61. The scraper 70 has, for example, a scraping blade 71 and its holder 72. The holder 72 holds the scraping blade 71 near the heating roller 61, pointing the scraping blade 71 opposite the direction of rotation of the heating roller 61 (counter direction).

Fixing Device of Embodiment 2

Figure 3:
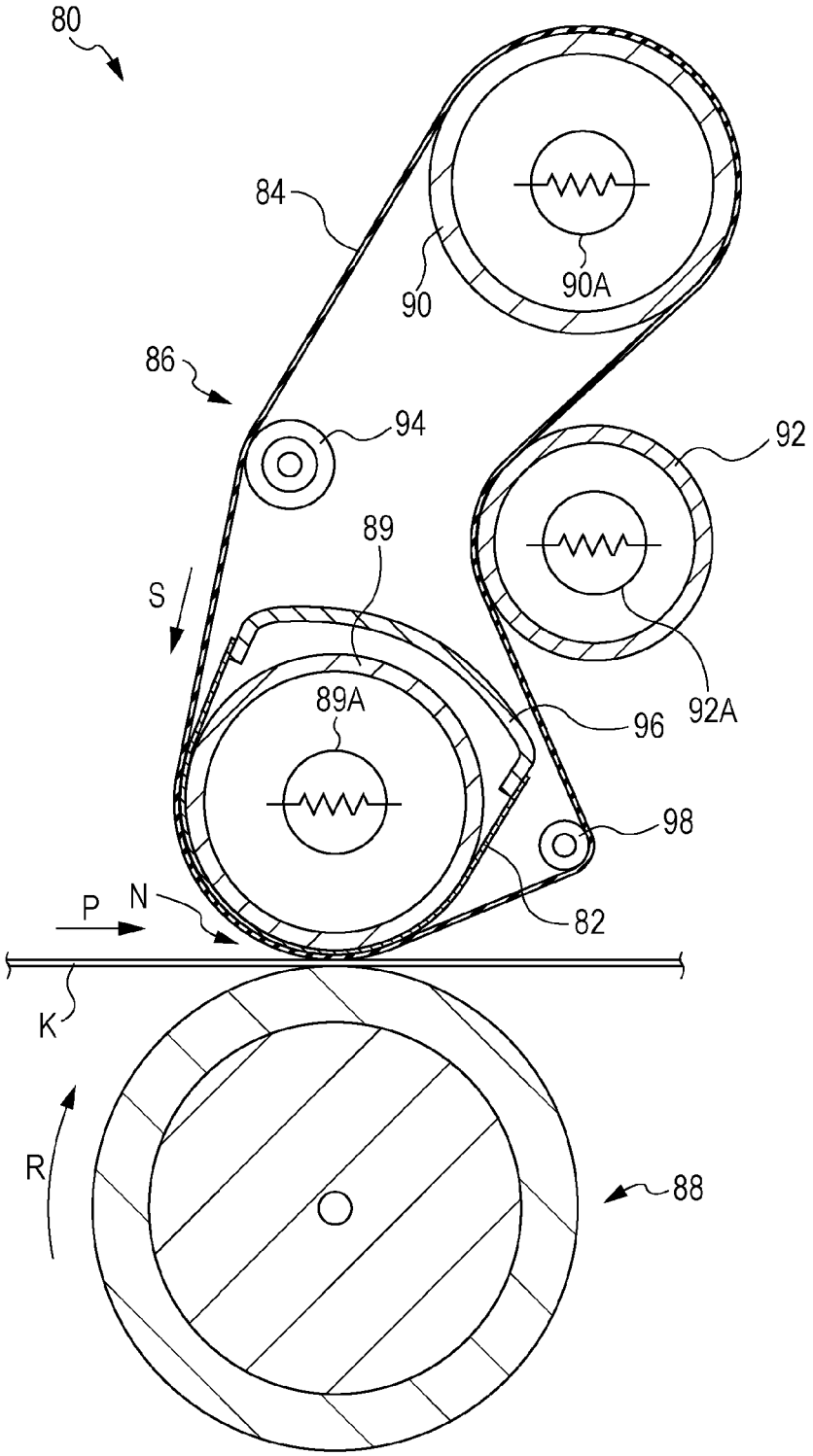
FIG. 3 schematically illustrates an example of a fixing device according to Embodiment 2.

The following describes a fixing device according to Embodiment 2. FIG. 3 schematically illustrates an example of a fixing device according to Embodiment 2.

As illustrated in FIG. 3, a fixing device 80 according to Embodiment 2 includes, for example, a fixing belt module 86 having a heating belt 84 (example of the first rotor) and a pressure roller 88 (example of the second rotor) pressed against the heating belt 84 (fixing belt module 86). There is, for example, a nip region N where the heating belt 84 (fixing belt module 86) and the pressure roller 88 come into contact. In the nip region N, paper K (example of a recording medium) with a toner image thereon is pressed and heated, and thereby the toner image is fixed.

The fixing belt module 86 includes, for example, an endless heating belt 84, a heat-press roller 89, and a supporting roller 90. The heat-press roller 89 is near the pressure roller 88, and the heating belt 84 has been looped around this heat-press roller 89. The heat-press roller 89 is rotated by the torque of a motor (not illustrated) while pressing the heating belt 84 on its inner circumferential surface toward the pressure roller 88. The supporting roller 90 supports the heating belt 84 from inside at a point different from where the heat-press roller 89 supports the heating belt 84.

The fixing belt module 86 also has, for example, two supporting rollers 92 and 98 and a position-adjusting roller 94. The supporting roller 92 is outside the heating belt 84 and defines the route along which the heating belt 84 moves around. The position-adjusting roller 94 adjusts the position of the heating belt 84 within the section from the supporting roller 90 to the heat-press roller 89. The supporting roller 98 is positioned downstream of the nip region N, the region where the heating belt 84 (fixing belt module 86) and the pressure roller 88 come into contact, and puts tension on the heating belt 84 on its inner circumferential surface.

Furthermore, the fixing belt module 86 has, for example, a sheet-shaped slider 82 interposed between the heating belt 84 and the heat-press roller 89.

The slider 82 is set in such a manner that, for example, its surface for sliding will touch the inner circumferential surface of the heating belt 84. There is oil between the heating belt 84 and the slider 82, and the design of the surface for sliding is relevant to the retention and supply of this oil.

The slider 82 is, for example, supported by a support 96 at both of its ends.

Inside the heat-press roller 89 is, for example, a halogen heater 89A (example of a heater).

The supporting roller 90 is, for example, an aluminum cylindrical roller. Inside the supporting roller 90 is a halogen heater 90A (example of a heater) so that the heating belt 84 can be heated from its inner circumferential surface side.

At both ends of the supporting roller 90 is, for example, a spring (not illustrated) that presses the heating belt 84 outwards.

The supporting roller 92 is, for example, an aluminum cylindrical roller. On the surface of the supporting roller 92 is a 20-μm thick fluoropolymer release layer.

The release layer on the supporting roller 92 is intended to, for example, prevent toner and/or paper dust falling down from the outer circumferential surface of the heating belt 84 from accumulating on the supporting roller 92.

Inside the supporting roller 92 is, for example, a halogen heater 92A (example of a heat source) so that the heating belt 84 can be heated from its outer circumferential surface side.

That is, the fixing belt module 86 is configured so that, for example, the heating belt 84 is heated by the heat-press roller 89 and supporting rollers 90 and 92.

The position-adjusting roller 94 is, for example, an aluminum rod-shaped roller. Near the position-adjusting roller 94 is an end-positioning mechanism (not illustrated), a mechanism that measures the position of the ends of the heating belt 84.

The position-adjusting roller 94 is equipped with, for example, an axial displacement mechanism (not illustrated), a mechanism that displaces the point of contact of the heating belt 84 in the axial direction in accordance with data from the end-positioning mechanism. This axial displacement mechanism controls the meandering of the heating belt 84.

The pressure roller 88 is, for example, rotatably supported and, by a biasing element (e.g., a spring) not illustrated, pressed against the portion of the heat-press roller 89 around which the heating belt 84 has been looped. This ensures that as the heating belt 84 (heat-press roller 89) of the fixing belt module 86 moves around in the direction of arrow S, the pressure roller 88 rotates in the direction of arrow R driven by the heating belt 84 (heat-press roller 89).

The paper K, with an unfixed toner image (not illustrated) thereon, is transported in the direction of arrow P and guided to the nip region N of the fixing device 80. While the paper K passes through the nip region N, the toner image is fixed by pressure and heat acting on the nip region N.

It should be understood that although the described fixing device 80 according to Embodiment 2 uses halogen heaters (halogen lamps) as an example of heat sources, other types of heaters may also be used, such as a radiant-lamp heating element (heating element that emits radiation (e.g., infrared light)) and a resistance heating element (heating element that generates Joule heat by passing an electric current through a resistor; e.g., a ceramic substrate with a fired electrically resistant film thereon).

Image Forming Apparatus

The following describes an image forming apparatus according to an exemplary embodiment.

An image forming apparatus according to this exemplary embodiment includes an image carrier, a charging component that charges the surface of the image carrier, a latent image forming component that forms a latent image on the charged surface of the image carrier, a developing component that develops the latent image with toner to form a toner image, a transfer component that transfers the toner image to a recording medium, and a fixing component that fixes the toner image on the recording medium. The fixing component is a fixing device according to an exemplary embodiment.

The following describes an image forming apparatus according to this exemplary embodiment with reference to a drawing.

Figure 4:
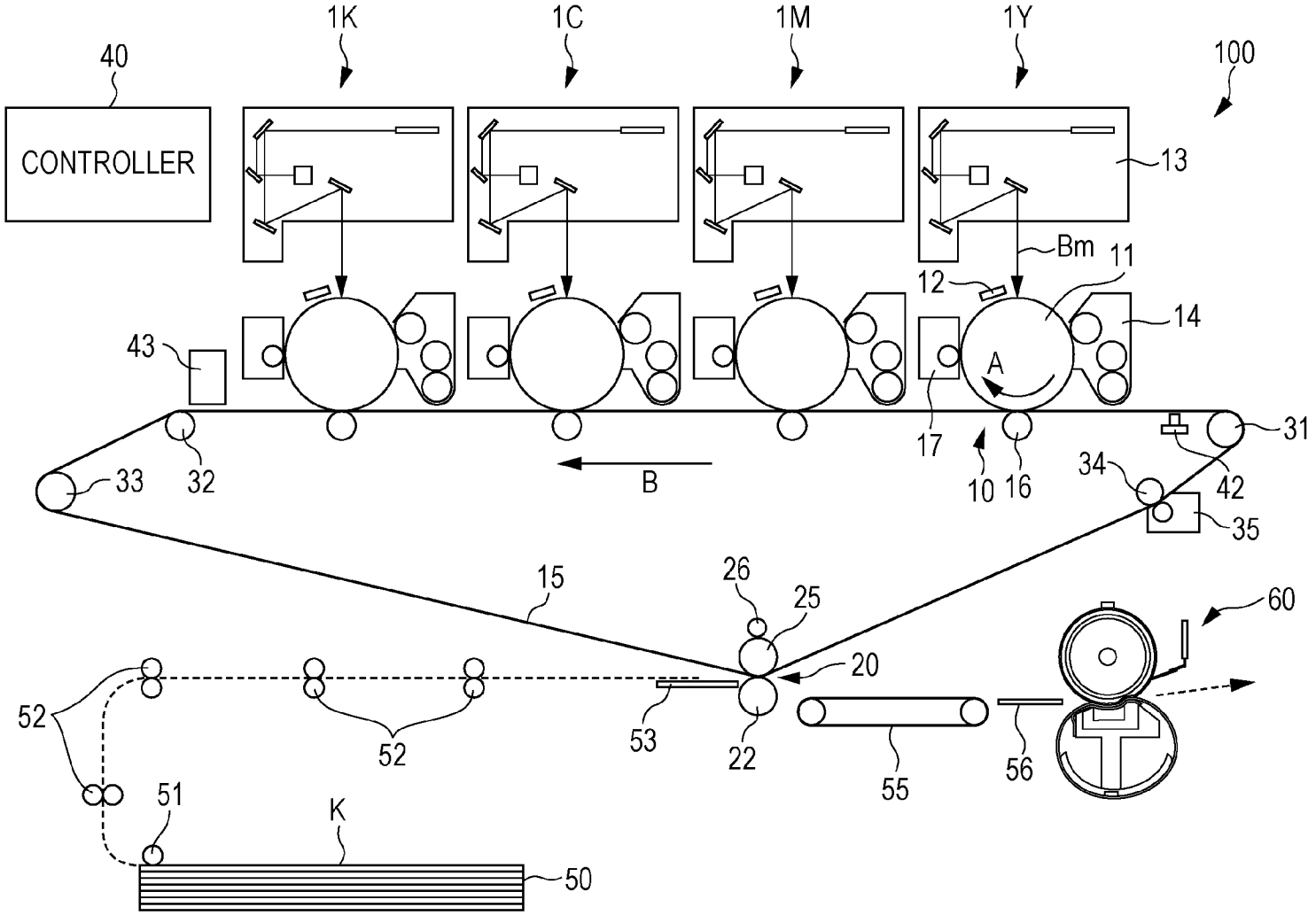
FIG. 4 schematically illustrates an example of an image forming apparatus according to an exemplary embodiment.

FIG. 4 schematically illustrates the construction of an image forming apparatus according to this exemplary embodiment.

As illustrated in FIG. 4, an image forming apparatus 100 according to this exemplary embodiment is, for example, an intermediate-transfer (more commonly tandem) image forming apparatus and includes multiple image forming units 1Y, 1M, 1C, and 1K that form toner images of the CMYK color components by electrophotography, a first transfer section 10 that transfers the toner images formed by the image forming units 1Y, 1M, 1C, and 1K to an intermediate transfer belt 15 one after another (first transfer), a second transfer section 20 that transfers the superimposed toner images on the intermediate transfer belt 15 to paper K as the recording medium all together (second transfer), and a fixing device 60 that fixes the transferred images on the paper K. Besides these units, sections, and device, the image forming apparatus 100 has a controller 40 that controls their operation.

The fixing device 60 is a fixing device 60 according to Embodiment 1. The image forming apparatus 100, however, may have a fixing device 80 according to Embodiment 2 instead.

The image forming units 1Y, 1M, 1C, and 1K of the image forming apparatus 100 each have a photoconductor 11. The photoconductor 11 is an example of the image carrier, a component that carries a toner image formed on the surface thereof, and rotates in the direction of arrow A.

Around the photoconductor 11 are a charger 12 and a laser illuminator 13. The charger 12 is an example of the charging component and charges the photoconductor 11. The laser illuminator 13 is an example of the latent image forming component and creates an electrostatic latent image on the photoconductor 11 (with a beam Bm as illustrated in the drawing).

There are also a developing system 14 and a first transfer roller 16 around the photoconductor 11. The developing system 14, an example of the developing component, contains toner of an assigned color component and turns the latent image on the photoconductor 11 into a visible image with the toner. The first transfer roller 16 transfers the toner image on the photoconductor 11 to the intermediate transfer belt 15 at the first transfer section 10.

Another element that surrounds the photoconductor 11 is a photoconductor cleaner 17, with which residual toner on the photoconductor 11 is removed. These electrophotographic devices of a charger 12, a laser illuminator 13, a developing system 14, a first transfer roller 16, and a photoconductor cleaner 17 are arranged in order in the direction of rotation of the photoconductor 11. These image forming units 1Y, 1M, 1C, and 1K are arranged substantially linearly in the order of yellow (Y), magenta (M), cyan (C), and black (K) from upstream of the intermediate transfer belt 15.

The intermediate transfer belt 15, which is the intermediate transfer body, is a film-like pressure belt formed by a resin base layer, for example a layer of polyimide or polyamide, and by a certain amount of antistatic additive, such as carbon black, contained therein. Its volume resistivity is $10^6$ Ωcm or more and $10^{14}$ Ωcm or less, and its thickness is, for example, approximately 0.1 mm.

The intermediate transfer belt 15 is circulated (moved around) by rollers in direction B in FIG. 4 at a speed selected in accordance with the purpose. The rollers include a driving roller 31 that is driven by a motor (not illustrated) good in speed stability and thereby rotates the intermediate transfer belt 15, a supporting roller 32 that supports the section of the intermediate transfer belt 15 extending substantially linearly along the line of photoconductors 11, a stretching roller 33 that puts tension on the intermediate transfer belt 15 and also serves as a correction roller that prevents the winding of the intermediate transfer belt 15, a back roller 25 at the second transfer section 20, and a cleaning back roller 34 at a cleaning section, a section that scrapes any residual toner off the intermediate transfer belt 15.

The first transfer section 10 is formed by first transfer rollers 16, rollers facing the photoconductors 11 with the intermediate transfer belt 15 therebetween. Each first transfer roller 16 is composed of a core and an elastic sponge layer surrounding and firmly attached to the core. The core is a rod of metal, for example a rod of iron or stainless steel. The sponge layer is a spongiform cylindrical roll of a nitrile rubber (NBR)/styrene-butadiene rubber (SBR)/ethylene-propylene-diene rubber (EPDM) blend containing an electrically conductive additive, such as carbon black, with a volume resistivity of $10^{7.5}$ Ωcm or more and $10^{8.5}$ Ωcm or less.

The first transfer rollers 16 make pressure contact with the photoconductors 11 with the intermediate transfer belt 15 therebetween. Whereas the toners are to be charged with a certain polarity of charge (negative charge; the same applies hereinafter), the first transfer rollers 16 are to be given the opposite polarity of voltage (first transfer bias). Owing to this, the toner images on the photoconductors 11 are electrostatically attracted to the intermediate transfer belt 15 one after another, forming superimposed toner images on the intermediate transfer belt 15.

The second transfer section 20 includes the back roller 25 and a second transfer roller 22, a roller facing the toner-image side of the intermediate transfer belt 15.

The back roller 25 is composed of a tube of an EPDM/NBR blend with carbon dispersed therein and EPDM, with the tube forming the surface and the EPDM forming the inside. Its surface resistivity is $10^7$Ω/□ or more and 10Ω/□ or less, and its hardness is, for example, 70° (Kobunshi Keiki ASKER Durometer Type C; the same applies hereinafter). This back roller 25 is on the back of the intermediate transfer belt 15 and forms an electrode facing the second transfer roller 22. A metal power-supply roller 26 is touching the back roller 25 to supply a second transfer bias stably.

The second transfer roller 22 is composed of a core and an elastic sponge layer surrounding and firmly attached to the core. The core is a rod of metal, for example a rod of iron or stainless steel. The sponge layer is a spongiform cylindrical roll of an NBR/SBR/EPDM blend containing an electrically conductive additive, such as carbon black, with a volume resistivity of $10^{7.5}$ Ωcm or more and $10^{8.5}$ Ωcm or less.

The second transfer roller 22 makes pressure contact with the back roller 25 with the intermediate transfer belt 15 therebetween. The second transfer roller 22 is grounded, and therefore a second transfer bias is created between the second transfer roller 22 and the back roller 25. With this second transfer bias, the toner images are transferred to paper K transported to the second transfer section 20 (second transfer).

Downstream of the second transfer section 20 of the intermediate transfer belt 15 is a detachable cleaner 35 for the intermediate transfer belt 15. The cleaner 35 cleans the surface of the intermediate transfer belt 15 after the second transfer by removing any residual toner and paper dust thereon.

The intermediate transfer belt 15, first transfer section 10 (first transfer rollers 16), and second transfer section 20 (second transfer roller 22) are collectively an example of the transfer component.

Upstream of the yellow image forming unit 1Y is a reference sensor (home-position sensor) 42. The reference sensor 42 generates a reference signal, a signal that provides the basis for timed image formation at the image forming units 1Y, 1M, 1C, and 1K. Downstream of the black image forming unit 1K is an image density sensor 43 for adjusting image quality. The reference sensor 42 generates a reference signal by recognizing marks made on the back of the intermediate transfer belt 15, and the controller 40 recognizes this reference signal and causes the image forming units 1Y, 1M, 1C, and 1K to start image formation.

An image forming apparatus according to this exemplary embodiment also includes a transport component that transports the paper K. The transport component includes a paper container 50 that holds the paper K, a paper feed roller 51 that takes up sheets of paper K from the paper container 50 and sends them out in a timed manner, transport rollers 52 that transport the paper K fed out by the paper feed roller 51, a transport guide 53 that directs the paper K transported by the transport rollers 52 to the second transfer section 20, a transport belt 55 that transports the paper K coming thereto after second transfer at the second transfer roller 22 to the fixing device 60, and a guide 56 for the entry to fixation that guides the paper K to the fixing device 60.

The following describes a typical process of image formation performed by an image forming apparatus according to this exemplary embodiment.

An image forming apparatus according to this exemplary embodiment processes image data, for example received from an image reader or personal computer (PC) not illustrated, with an image processor not illustrated and then performs image formation with the image forming units 1Y, 1M, 1C, and 1K.

The image processor processes the input reflectance data, for example by performing shading correction, misregistration correction, lightness/color space conversion, gamma correction, edge trimming, and types of editing such as changing colors and moving positions. The processed image data is converted into tonal data for the four colors of Y, M, C, and K, and these tonal data are output to the laser illuminators 13.

The laser illuminators 13 irradiate the photoconductor 11 of the image forming units 1Y, 1M, 1C, and 1K with a beam Bm, for example emitted from a semiconductor laser, in accordance with the input tonal data. Since the surface of the photoconductor 11 of the image forming units 1Y, 1M, 1C, and 1K has been charged by the chargers 12, this process of exposure performed by the laser illuminators 13 creates electrostatic latent images on the surface of the photoconductors 11. The created latent images are developed by the developing systems 14 into toner images in the colors of Y, M, C, and K.

The toner images formed on the photoconductor 11 of the image forming units 1Y, 1M, 1C, and 1K are transferred to the intermediate transfer belt 15 at the first transfer section 10, where the photoconductors 11 and the intermediate transfer belt 15 come into contact. More specifically, at the first transfer section 10, the toners have a certain polarity of charge (negative charge), and the first transfer rollers 16 apply the opposite polarity of voltage (first transfer bias) to the substrate of the intermediate transfer belt 15. As a result, the toner images are superimposed on the surface of the intermediate transfer belt 15 one after another (first transfer).

After the sequential, first transfer of the toner images to the surface of the intermediate transfer belt 15, the intermediate transfer belt 15 moves and transports the toner images to the second transfer section 20. While the toner images are being transported to the second transfer section 20, the paper feed roller 51 in the transport component rotates synchronously therewith, feeding paper K of the desired size from the paper container 50. The paper K fed by the paper feed roller 51 is transported by the transport rollers 52 and reaches the second transfer section 20 via the transport guide 53. Before arriving at the second transfer section 20, the paper K is stopped to wait for positional registration. A registration roller (not illustrated) rotates synchronously with the movement of the intermediate transfer belt 15 carrying the toner images to align the position of the paper K and the toner images.

At the second transfer section 20, the second transfer roller 22 is pressed against the back roller 25 with the intermediate transfer belt 15 therebetween. The paper K, transported there at the same time, is caught between the intermediate transfer belt 15 and the second transfer roller 22. The toners have a certain polarity of charge (negative charge), and the power-supply roller 26 supplies the same polarity of voltage (second transfer bias). This produces a transfer electric field between the second transfer roller 22 and the back roller 25. As a result, the unfixed toner images on the intermediate transfer belt 15 are electrostatically transferred all together to the paper K at the second transfer section 20, where the intermediate transfer belt 15 is pressed by the second transfer roller 22 and the back roller 25.

The paper K with the toner images electrostatically transferred thereto then comes off the intermediate transfer belt 15 and in that state is transported by the second transfer roller 22 to the transport belt 55, located downstream in the direction of the paper transportation by the second transfer roller 22. The transport belt 55 transports the paper K to the fixing device 60 at a speed suitable for its entry to the fixing device 60. At the fixing device 60, the unfixed toner images on the paper K are fixed on the paper K by heat and pressure given by the fixing device 60. The paper K with a fixed image thereon is then transported to a paper output container (not illustrated), a container placed at the exit of the image forming apparatus 100.

Any toner that remains on the intermediate transfer belt 15 after transfer to the paper K is transported to the cleaning section with the movement of the intermediate transfer belt 15 and is removed from the intermediate transfer belt 15 by the cleaning back roller 34 and the cleaner 35 for the intermediate transfer belt 15.

EXAMPLES

The following describes exemplary embodiments of the present disclosure in further detail by providing examples. It should be noted that the present disclosure is not limited to these examples. In the following description, all "parts" and "%" are by mass unless stated otherwise.

Example 1

Substrate

An aluminum cylindrical substrate is prepared.

Elastic Layer

Forty parts by mass of dimethylpolyorganosiloxane (viscosity (25° C.), 30000 Pa·s) and 100 parts by mass of fine alumina powder (volume-average particle diameter, 3 μm) are put into a blender and heated and blended at 150° C. for 2 hours. The resulting blend is mixed with 60 parts by mass of dimethylpolyorganosiloxane (same as above) and then 4 parts by mass of a dimethylsiloxane/methylhydrogensiloxane copolymer trimethylsiloxy-terminated at both ends (viscosity (25° C.), 5 mPa·s), 10 ppm (on a platinum basis) of chloroplatinic acid-divinyltetramethyldisiloxane complex as a catalyst, 0.1 parts by mass of 1-ethynyl-1-cyclohexanol as a curing retarder, and 2 parts by mass of ferric oxide ($Fe_3O_4$) to give a silicone rubber composition.

Then the aluminum cylindrical substrate is coated with a primer (Dow Corning Toray DY39-051 A/B). The silicone rubber composition is then dribbled onto the primer-coated cylindrical substrate from above. During this, the cylindrical substrate is rotated with its axis held horizontal and with a blade pressed against its bottom so that a coating of the silicone rubber composition will be formed. The coating is fired at 200° C. for 1 hour. In this way, an elastic layer (average thickness, 600 μm) is formed on the substrate.

Surface Layer

A PFA tube is prepared that has a film thickness of 30 μm and a diameter 2% smaller than the outer diameter of the cylindrical substrate. The PFA tube is attached to the inside of a container, and the container is evacuated. Then an inner mold is inserted into the cylindrical substrate with the elastic layer thereon. The inner mold has a dilator at one end and is inserted from the other end, opposite the dilator. Then the cylindrical substrate, with the inner mold therein and the elastic layer thereon, is inserted into the PFA tube attached to the inside of the container, from the end of the substrate at which the inner mold has the dilator into one end of the tube. While dilating the PFA tube with the dilator, the cylindrical substrate is brought through the tube in such a manner that the PFA tube will be stretched longitudinally (transversely), or in the direction along the axis of the fixing member to be produced, to a percentage elongation of 0%, which is within the elastic deformation range, based on the length of the PFA tube upon covering. At the arrival of the dilator at the other end of the PFA tube, the suction is ended and air is let in. This makes the elastic layer covered with the PFA tube and the tube narrow. In this way, a 30-μm thick surface layer is formed.

Through these processes, a fixing roller of Example 1 is prepared.

Example 2

A fixing roller of Example 2 is prepared as in Example 1, but the transverse (longitudinal) stretching of the PFA tube, or in the direction along the axis of the fixing member to be produced, with the dilator is to a percentage elongation of 3%, which is within the elastic deformation range, based on the length of the PFA tube upon covering.

Examples 3 to 5 and Comparative Example 3

Fixing rollers of these Examples and Comparative Example are prepared as in Example 1, but with a different percentage elongation according to Table 1.

Example 6

A fixing roller of Example 6 is prepared as in Example 1, but the formation of the surface layer is as follows.

A PFA tube is prepared that has a film thickness of 30 μm and a diameter 2% smaller than the outer diameter of the cylindrical substrate with the elastic layer thereon. This PFA tube is attached to the inner circumference of an outer mold. The outer mold has an inner diameter 0.8% larger than the outer diameter of the cylindrical substrate including the elastic layer. The PFA tube is then stretched transversely (longitudinally), or in the direction along the axis of the fixing member to be produced, to a percentage elongation of 1%, which is within the elastic deformation range, and is dilated with this percentage elongation held. Then the cylindrical substrate, with the elastic layer thereon, is inserted into the PFA tube, and in this state the PFA tube is removed from the outer mold. This makes the elastic layer covered with the PFA tube and the tube narrow. In this way, a 40-μm thick surface layer is formed.

Comparative Examples 1 and 2

Fixing rollers of Comparative Examples 1 and 2 are prepared as in Example 1, but the formation of the surface layer is as follows.

A PFA tube is prepared that has a film thickness of 30 μm and a diameter 2% smaller than the outer diameter of the cylindrical substrate. The elastic layer, formed as in Example 1, is then coated with an addition-curing silicone rubber adhesive agent. A rod-shaped inner mold is inserted into the cylindrical substrate with the adhesive-coated elastic layer thereon, forming a substrate with the inner mold therein and the adhesive-coated elastic layer thereon. This substrate is inserted to the inside, or into the space surrounded by the inner circumferential surface, of the PFA tube, dilating the PFA tube. One end of the PFA tube is fastened at multiple circumferential points. Then the other end of the PFA tube is stretched transversely (longitudinally), or in the direction along the axis of the fixing member to be produced, to the plastic deformation range and fastened at multiple circumferential points. The percentage elongation is 6% in Comparative Example 1 and 8% in Comparative Example 2. The workpiece is then heated at 200° C. for 60 minutes using an electric furnace to cure the addition-curing silicone rubber adhesive agent. In this way, fixing rollers of Comparative Examples 1 and 2 are prepared.

Comparative Example 4

A fixing roller of Comparative Example 4 is prepared as in Example 6, but the thickness of the surface layer is changed to 100 μm.

Testing

The fixing rollers obtained in these Examples and Comparative Examples are subjected to the following measurements and evaluations.

22° C. and a relative humidity of 55%, one hundred sheets of A4 paper are passed, and then a full-page magenta halftone image is printed on a sheet with a density of 50%. Then 150,000 sheets of A4 paper are passed, and a full-page magenta halftone image is printed on a sheet with a density of 50%. The full-page halftone images are visually inspected and classified as follows.

A: No unevenness in gloss.

B: Partial unevenness in gloss, but practically acceptable.

C: Unevenness in gloss is practically unacceptable.

The results are presented in Table 1.

TABLE 1

| | Surface layer | | | | | | | | | | | Testing | | | |
|---|---|---|---|---|---|---|---|---|---|---|---|---|---|---|---|
| | Transverse elongation (%) | Thickness (μm) | Microhardness | N = 1 | N = 2 | N = 3 | N = 4 | N = 5 | Max − Min | Ave | Wcm (μm) | Appearance: Initial | Appearance: After durability testing | Image quality: Density unevenness | Image quality: Overall grade |
| Example 1 | 0 | 30 | Axial | 86 | 86 | 86 | 87 | 87 | 1 | 86 | 4 | A | A | B | A |
| | | | Circumferential | 86 | 86 | 86 | 86 | 86 | 0 | 86 | | | | | |
| Example 2 | 3 | 30 | Axial | 86 | 86 | 86 | 87 | 87 | 1 | 86 | 2 | A | A | B | A |
| | | | Circumferential | 86 | 86 | 87 | 86 | 86 | 1 | 86 | | | | | |
| Example 3 | 5 | 30 | Axial | 85 | 86 | 86 | 87 | 87 | 2 | 86 | 0.8 | A | A | A | A |
| | | | Circumferential | 85 | 86 | 86 | 87 | 87 | 2 | 86 | | | | | |
| Example 4 | 1 | 30 | Axial | 85 | 86 | 86 | 87 | 87 | 2 | 86 | 3 | A | A | A | A |
| | | | Circumferential | 85 | 86 | 86 | 87 | 87 | 2 | 86 | | | | | |
| Example 5 | 4 | 30 | Axial | 86 | 86 | 88 | 87 | 87 | 2 | 87 | 1 | A | A | A | A |
| | | | Circumferential | 86 | 86 | 87 | 87 | 87 | 1 | 87 | | | | | |
| Example 6 | 1 | 40 | Axial | 87 | 87 | 87 | 87 | 88 | 1 | 87 | 0.8 | A | A | A | A |
| | | | Circumferential | 87 | 88 | 87 | 87 | 88 | 1 | 87 | | | | | |
| Comparative Example 1 | 6 | 30 | Axial | 82 | 86 | 86 | 87 | 85 | 5 | 85 | 0.3 | A | B | C | B |
| | | | Circumferential | 82 | 86 | 85 | 86 | 85 | 4 | 85 | | | | | |
| Comparative Example 2 | 8 | 30 | Axial | 80 | 84 | 86 | 85 | 83 | 6 | 84 | 0.4 | A | B | C | B |
| | | | Circumferential | 81 | 84 | 86 | 85 | 84 | 5 | 84 | | | | | |
| Comparative Example 3 | −1 | 30 | Axial | 86 | 86 | 86 | 87 | 87 | 1 | 86 | 9 | B | — | C | B |
| | | | Circumferential | 86 | 85 | 85 | 86 | 86 | 1 | 86 | | | | | |
| Comparative Example 4 | 1 | 100 | Axial | 92 | 92 | 92 | 91 | 92 | 1 | 92 | 0.3 | A | B | C | B |
| | | | Circumferential | 91 | 91 | 92 | 92 | 91 | 1 | 91 | | | | | |

Microhardness

As described, the microhardness of the surface layer is measured at five points in the transverse direction, or in the direction along the axis of the fixing roller, and in the circumferential direction using MD-1 micro-durometer (polymer A-type (Kobunshi Keiki)).

Filtered Maximum Waviness Wcm

As described, the filtered maximum waviness Wcm of the surface layer is measured in the transverse direction, or in the direction along the axis of the fixing roller, using a surface roughness measuring instrument (SURFCOM 2000, Tokyo Seimitsu Co., Ltd.).

Appearance (Break and Cracks) Evaluation

The fixing roller is attached to the fixing device of an image forming apparatus (DocuCentre-III C3300, Fuji Xerox Co., Ltd.), and this fixing device is set in the image forming apparatus. Using this image forming apparatus, an image is output on 1000 (initial) and 400,000 sheets (after durability testing) of J paper (Fuji Xerox Co., Ltd.) as running tests. Then the surface of the surface layer is visually inspected and evaluated against the following criteria.

A: No crease or crack has occurred.

B: A crease and/or a crack has occurred.

Density Unevenness (Unevenness in Gloss) Evaluation

The fixing roller is attached to the fixing device of an image forming apparatus (DocuCentre-III C3300, Fuji Xerox Co., Ltd.). In an atmosphere having a temperature of As can be seen from the results, Examples are better than Comparative Examples in density unevenness.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing member comprising:

a substrate;

an elastic layer on the substrate; and a surface layer on the elastic layer, the surface layer having transverse microhardness values within a range of 85 to 89, inclusive, and a transverse filtered maximum waviness, Wcm, of 0.1 μm or more and 4 μm or less, wherein the difference between the maximum and minimum of the transverse microhardness values is 2 or less.

2. The fixing member according to claim 1, wherein the surface layer has circumferential microhardness values within a range of 85 to 89, inclusive.

3. The fixing member according to claim 2, wherein the difference between the maximum and minimum of the circumferential microhardness values is 2 or less.

4. The fixing member according to claim 2, wherein the average of the transverse microhardness values is 86 or more and 88 or less, and the average of the circumferential microhardness values is 86 or more and 88 or less.

5. The fixing member according to claim 3, wherein the average of the transverse microhardness values is 86 or more and 88 or less, and the average of the circumferential microhardness values is 86 or more and 88 or less.

6. The fixing member according to claim 1, wherein the transverse filtered maximum waviness is 0.1 μm or more and 1 μm or less.

7. The fixing member according to claim 1, wherein the surface layer contains a heat-resistant mold lubricant.

8. The fixing member according to claim 7, wherein the heat-resistant mold lubricant is a fluoropolymer.

9. The fixing member according to claim 1, wherein the surface layer has a thickness of 5 μm or more and 100 μm or less.

10. The fixing member according to claim 9, wherein the thickness of the surface layer is 10 μm or more and 40 μm or less.

11. A method for producing the fixing member according to claim 1, the method comprising:

forming an elastic layer on a substrate; and forming a surface layer on the elastic layer by dilating a material for forming the surface layer, covering the elastic layer with the material for forming the surface layer while transversely stretching the material within the elastic deformation range thereof, and narrowing the material for forming the surface layer.

12. The method according to claim 11 for producing a fixing member, wherein the material for forming the surface layer is transversely stretched to a percentage elongation of 0% or more and 6% or less based on the material for forming the surface layer that has yet to be stretched.

13. A fixing device comprising a first rotor and a second rotor in contact with the outer surface of the first rotor, at least one of the first and second rotors being the fixing member according to claim 1.

14. An image forming apparatus comprising:

an image carrier;

a charging component that charges the surface of the image carrier;

a latent image forming component that forms a latent image on the charged surface of the image carrier;

a developing component that develops the latent image with toner to form a toner image;

a transfer component that transfers the toner image to a recording medium; and a fixing component that fixes the toner image on the recording medium, the fixing component being the fixing device according to claim 13.

* * * * *